United States Patent [19]

Helmus

[11] 4,125,165

[45] Nov. 14, 1978

[54] ANNULUS PRESSURE CONTROLLED TEST VALVE WITH LOCKING ANNULUS PRESSURE OPERATED PRESSURE TRAPPING MEANS

[75] Inventor: Sydney S. Helmus, London, England

[73] Assignee: Baker International Corporation, Orange, Calif.

[21] Appl. No.: 817,805

[22] Filed: Jul. 21, 1977

[51] Int. Cl.[2] ..... E21B 43/12; E21B 47/00

[52] U.S. Cl. ..... 166/323; 166/264

[58] Field of Search ..... 166/264, 319, 321, 323, 166/324

[56] References Cited

U.S. PATENT DOCUMENTS

| | | | |
|---|---|---|---|
| 3,856,085 | 12/1974 | Holden et al. | 166/0.5 |
| 3,858,649 | 1/1975 | Wray et al. | 166/321 |
| 3,964,305 | 6/1976 | Farley et al. | 166/321 |
| 3,964,544 | 6/1976 | Farley et al. | 166/321 |
| 3,976,136 | 8/1976 | Farley et al. | 166/319 |

*Primary Examiner*—Ernest R. Purser

*Attorney, Agent, or Firm*—Christie, Parker & Hale

[57] ABSTRACT

Well test apparatus having, in a well, an annulus therearound. An annular housing has a valve for the control of fluid flow through the housing. A pressure chamber is provided within the housing. Lockable pressure trapping means is responsive to annulus pressure for locking in a condition wherein pressure is trapped in the pressure chamber. A piston is responsive to trapped pressure in the pressure chamber and to annulus pressure for control of the valve.

25 Claims, 19 Drawing Figures

166
152
10b
5
152
122
5
136
106a
12
10c
10c
114
112
106
110
108
118
120
106
122
106b
28
26
30
12
130
18a
18
130
29
132
10d
31
12
12
24
10e
18
10d
42
44
40
16
18b
38
37
12
48

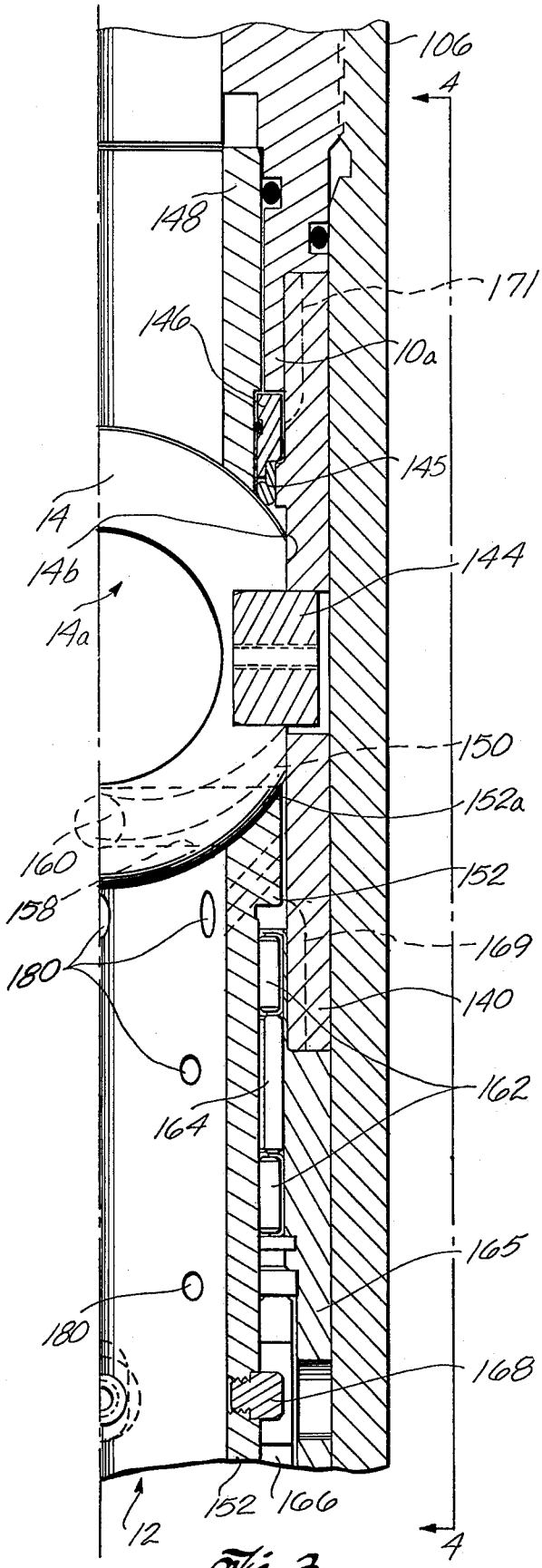
Fig. 3
Fig. 4
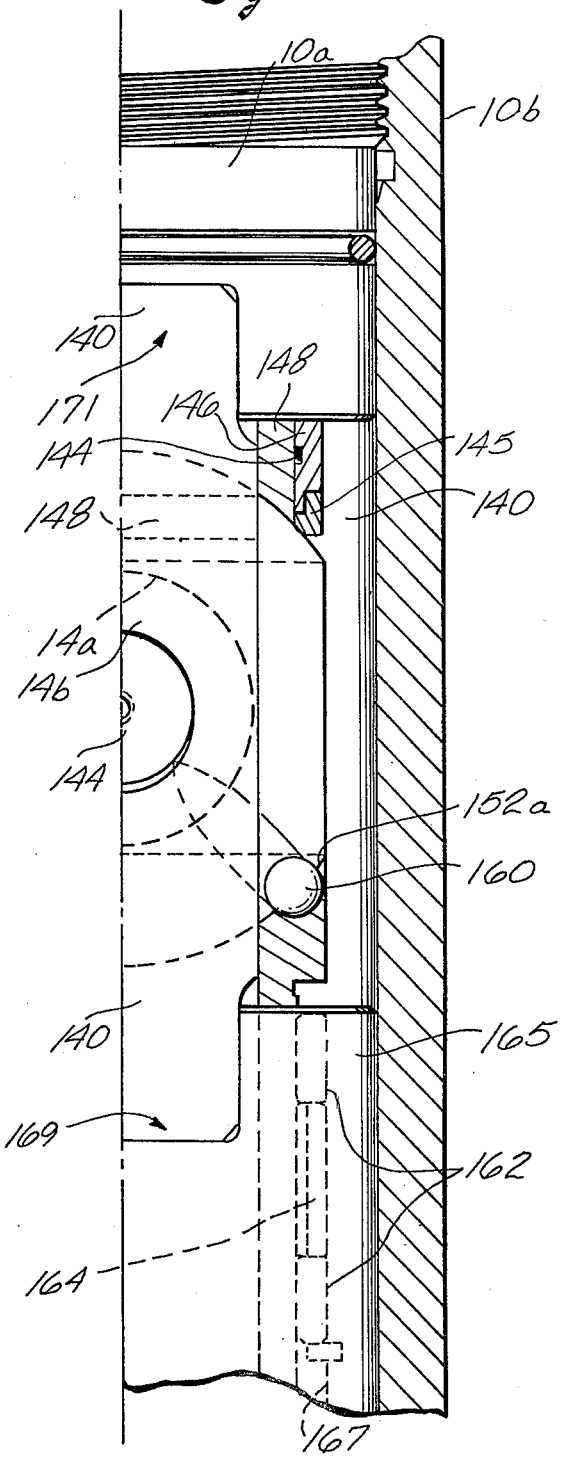

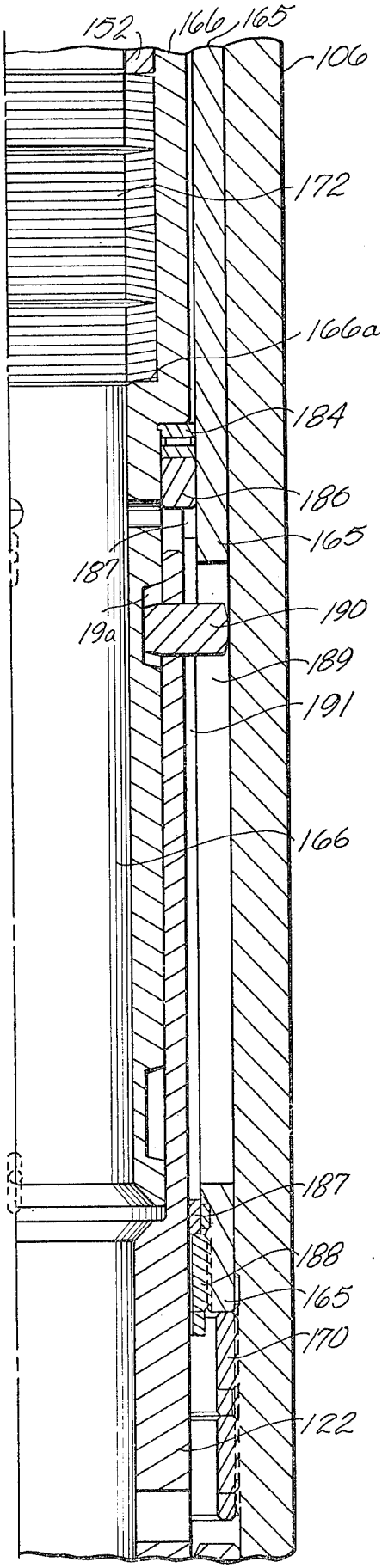
Fig. 5
Fig. 6
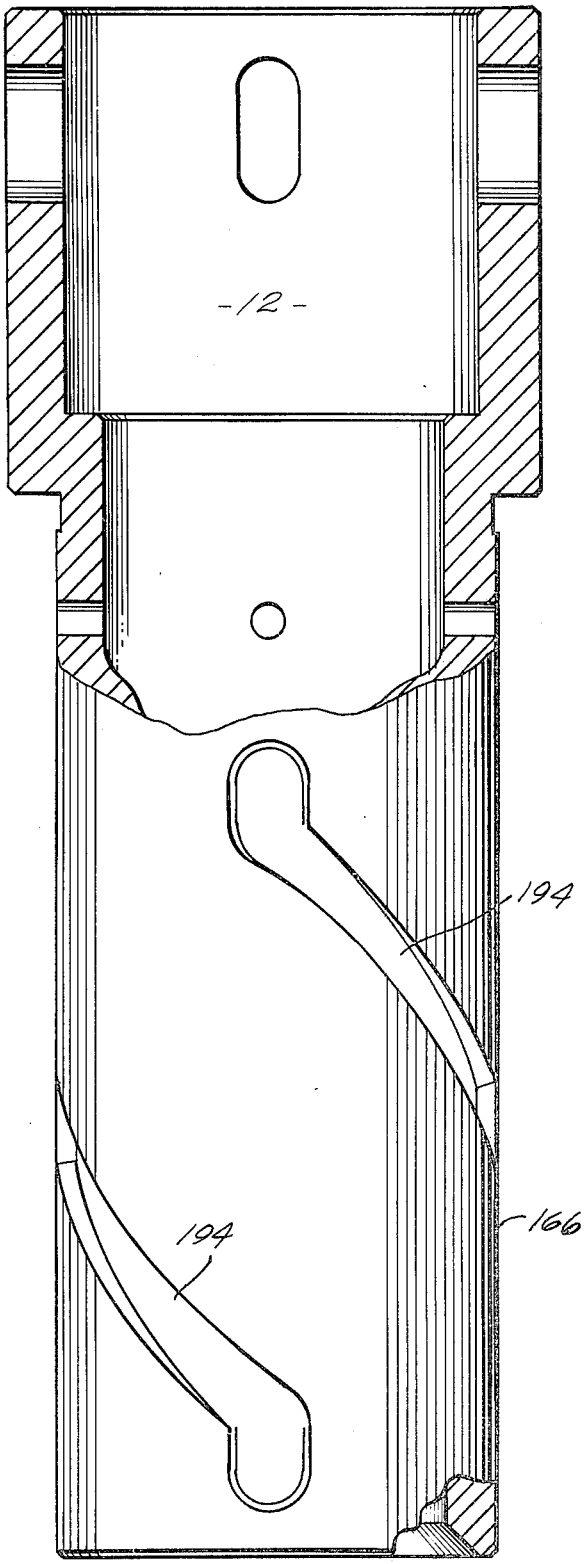

ANNULUS PRESSURE CONTROLLED TEST VALVE WITH LOCKING ANNULUS PRESSURE OPERATED PRESSURE TRAPPING MEANS

BACKGROUND OF THE INVENTION

This invention relates to well test apparatus and more particularly to annulus pressure operated test valves. Test valves are well known for testing the flow of fluid from a formation in a well hole. Test valves are also known for offshore testing from floating vessels.

Test valves are desired which can be remotely actuated to open and close a central passage and thereby control the passage of fluid from the formation up the central passage of a test string in which such a test valve is connected.

Various types of test valves for this purpose are known. One such test valve is one which is operated responsive to up and down mechanical movement of the test string. However, such a device is not suitable for testing offshore wells from a floating rig which is subjected to vertical motion.

Accordingly an alternate type of test valve has been developed which responds to annulus pressure within the annulus between the test valve and the well casing. An increase in annulus pressure causes the central passage valve to open and a decrease in annulus pressure causes the central passage valve to close. Hydrostatic annulus head pressure is used as a reference and only opens the test valve when the annulus pressure exceeds the reference. To this end it has been proposed to anticipate the magnitude of the hydrostatic pressure down hole and trap an equal amount of pressure in a pressure chamber. The trapped pressure is then used as a reference so that when annulus pressure exceeds the trapped pressure, the central passage valve opens. A differential control mechanism urges the valve closed when trapped pressure exceeds annulus pressure and urges the valve open when annulus pressure exceeds trapped pressure. This approach requires a relatively high pressure to be trapped in the test valve at the surface, which is dangerous, and requires a rather accurate precalculation of the down hole pressure.

To avoid trapping high pressure at the top of the well, test valves have been developed that have a pressure chamber which is open to annulus pressure as the test valve is lowered into the well. A mechanically operated pressure trapping valve is provided which is operated by mechanical down movement of the test string after the test valve has been positioned in place at the bottom of the well hole to thereby trap the hydrostatic annulus pressure in the pressure chamber as the reference.

One test valve is known which uses, in place of the mechanically operated pressure trapping valve, an annulus pressure operated pressure trapping valve. This device employs a differential pressure operated shuttle valve for trapping pressure in the pressure chamber. The differential pressure operated shuttle valve is spring biased open so that annulus pressure enters the pressure chamber. The force due to annulus pressure and central passage pressure acts in opposite directions on the shuttle valve and when annulus pressure is raised so that it exceeds central passage pressure, the shuttle valve closes thereby trapping annulus pressure in the pressure chamber. When annulus pressure decreases sufficiently, the shuttle valve reopens. This cycle is repeatable.

However, a problem may occur in such a test valve when a well is acidized through the test valve. When acidizing, annulus pressure is first increased, first causing the shuttle valve to close, trapping approximately hydrostatic annulus pressure and second, causing the differential control for the central passage valve to open the central passage valve. Pressurized acid is pumped down the tubing in which the test valve is connected. However, should the elevated pressure of the acid in the central passage in combination with spring force cause the shuttle valve to open, the pressure will suddenly increase in the pressure chamber, eliminating the pressure differential which is utilized by the differential control for maintaining the central passage valve open. This will cause the test valve to malfunction and erroneously close the central passage valve.

BRIEF STATEMENT OF THE INVENTION

Briefly, an embodiment of the present invention is a test apparatus having, in a well, an annulus therearound. A tubular housing has a valve therein for the control of fluid flow through the housing. A pressure chamber is provided within the housing. Significantly, a lockable pressure trapping means is responsive to annulus pressure for locking in a condition wherein pressure is trapped in the pressure chamber. Control means is responsive to trapped pressure in the pressure chamber and to annulus pressure for control of the valve. With such an arrangement the pressure remains trapped in the pressure chamber independently of changes in pressure in and around the test valve such as the central passage pressure and the annulus pressure. Thus, pressure increases in the central passage even in excess of annulus pressure, such as occur during acidizing operations, will not erroneously cause the valve to reopen.

DETAILED DESCRIPTION OF DRAWINGS

FIG. 1 is a schematic and pictorial illustration of a formation testing system including an offshore floating platform and embodying the present invention;

FIGS. *2a–2f* are a side elevation view, on a reduced scale, of the annulus pressure operated test valve of FIG. 1 with a quarter section thereof cut away along the right hand side to reveal the internal construction thereof; the sections of the test valve depicted in FIGS. *2a–2f* are connected together as indicated by broken lines;

FIG. 3 is an enlarged view of the right quarter section of the test valve depicted at FIG. *2a* taken between lines 3—3;

FIG. 4 shows a portion of the test valve depicted in FIG. 3 rotated 90° to that in FIG. 3;

FIG. 5 is an enlarged view of the right quarter section of the test valve depicted between the lines 5—5 of FIG. *2b;*

FIG. 6 is an enlarged side elevation view partly in cross-section of the cam sleeve showing the camways;

GENERAL DESCRIPTION

Figure 1:
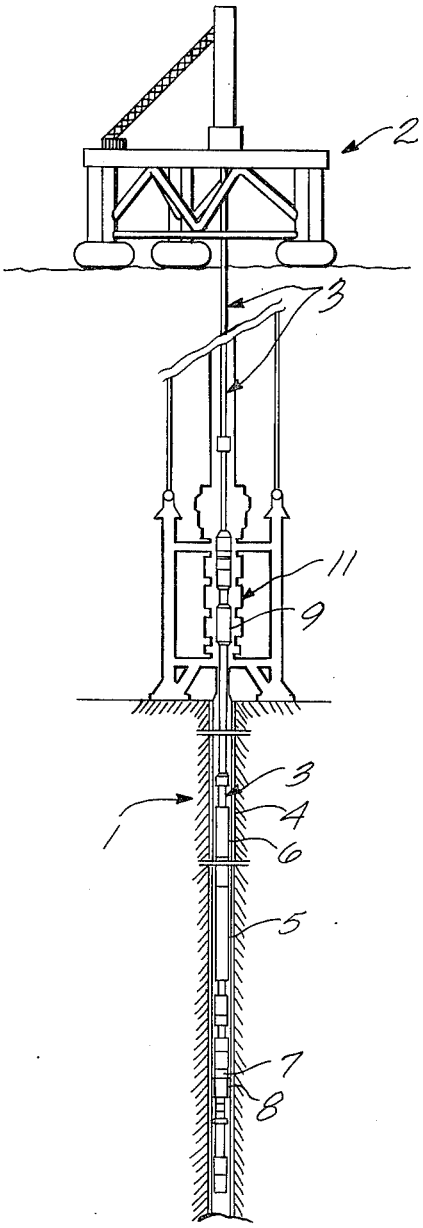

FIG. 1 discloses a typical offshore system for testing the formation in a well hole 1 at the bottom of the ocean floor. A floating platform 2 is located on the surface of the ocean above the well hole 1. Extending within an annular casing is depicted an annulus pressure operated test valve 5, an annulus pressure operated reversing valve 6, and a subsea production test valve 9 serially connected together in a test string 3. A central passage for fluid extends up the test string. At the bottom of the test string is provided a floating seal assembly 7 and a packer 8 is affixed on the inside wall of the casing 4 just above the portion of the formation for test. A blow-out preventer stack 11 is located on the ocean floor over the well hole 1.

The test valve 5 has a central passage valve which is closed when run down-hole and after testing. The reversing valve 6 opens a passage between the central passage therein and the annulus around the reversing valve to allow, as explained in more detail, annulus fluid to enter and move up the test string above the closed test valve.

In operation, the test string including the test valve 5, the reversing valve 6, the floating seal assembly 7, and the subsea production test valve 9, are run into the casing 4 with the test valve 5 and the reversing valve 6 in their closed conditions.

When the test string is landed, the subsea production test valve 9 and the test string below are supported by the well head. Blow-out preventers in the stack 11 are closed around the subsea production test valve 9 to seal the well head. Also the floating seal assembly 7 is inserted into the packer 8 thereby sealing the annulus between the tubing and the floating seal assembly 7 against the passage of fluid in the annulus past the packer 8. As a result, pressure in the annulus around the test string within the casing 3, between the upper side of the packer 8 and the surface, can be raised or lowered through a "kill line" at the surface as well known in the art.

As the floating seal assembly 7 is inserted into the packer, fluid will be displaced up the central passage of the test string to the closed test valve, increasing the pressure therein. If this pressure is not relieved, fluid may be forced back into the formation below the packer and this is not desirable. Significantly a bypass is provided through the test valve from the central passage to the annulus to allow the increased pressure to be released into the annulus above the packer.

In operation, the annulus pressure operated test valve 5 is operated by changes in annulus pressure. Briefly, the test tool is first set by closing a locking valve which traps a predetermined amount of pressure in a pressure chamber. The amount of pressure that is trapped is selected so that it exceeds hydrostatic head pressure at the test valve by about 700 to 1000 pounds per square inch (psi). To open the test valve, the annulus pressure must be increased at the test valve so that the pressure exceeds the trapped pressure. Each time pressure in the annulus is increased to overcome the trapped pressure, a central passage valve in the test valve 5 opens, allowing well fluid in the well formation from below to pass up through the test valve 5 to the test string above. Each time annulus pressure is reduced or bled off, the central passage valve closes, preventing the passage of central passage fluid. The opening and closing of the central passage valve caused by the increase and decrease of the annulus pressure can be repeated over and over as desired and each time the test valve 5 will open and close. Significantly the valve which traps pressure remains locked closed and hence the trapped pressure remains trapped.

However, annulus over-pressure will cause the central passage valve to permanently close. The over-pressure may occur because of a leakage of gas into the annulus or it may be deliberately introduced under control at the surface.

After the desired pressure cycles of the test valve 5, the central passage valve will normally be permanently closed by over-pressuring the annulus. As the over-pressure builds up, the central passage valve 5 first opens but as soon as it reaches the over-pressure condition the central passage valve automatically closes and thereafter cannot be reopened. At this point the test string central passage above the now closed test valve will be filled with production fluid, from the formation, which must be displaced before it is safe to retrieve the test string. To this end the reversing valve 6 when open allows annulus fluid to flow transversely from the annulus through the side of the reversing valve into the central passage and up through the test string, displacing the formation fluid above to the surface. After the formation fluid has been displaced out of the test string, the tools are retrieved as discussed above.

Should the test valve be raised to the surface with the trapped pressure, a potentially explosive and dangerous condition would exist because of the high pressure involved. Accordingly the trapped pressure is automatically released to the annulus around the test valve as it is raised to the surface.

It is possible to hang wire line retrievable pressure and temperature recorders in special nipples provided for that purpose in a tailpipe extending below the floating seal assembly 7 as is well known in the art.

DETAILED DESCRIPTION

Consider now the details of the test valve as depicted in FIGS. *2a–2f.* The test valve is generally symmetrical about its axis unless othewise noted and therefore can be understood from the quarter section that is shown. FIGS. *2a–2f* depict the test valve in its closed position as it is being lowered down into the well hole before annulus pressure has affected the test valve.

The test valve has an elongated tubular shaped housing 10. Although not important to the present invention, the housing 10 is made up of a series of subassemblies **10*a*–10*h*** which are threaded together at their joints generally as indicated.

The housing 10 contains the centrally located generally circular shaped passage 12 which extends from an upper end **10*i* to a lower end 10*j*** of the housing and communicates with the central passage in the tubing string above and below the test valve.

Figure 2A:
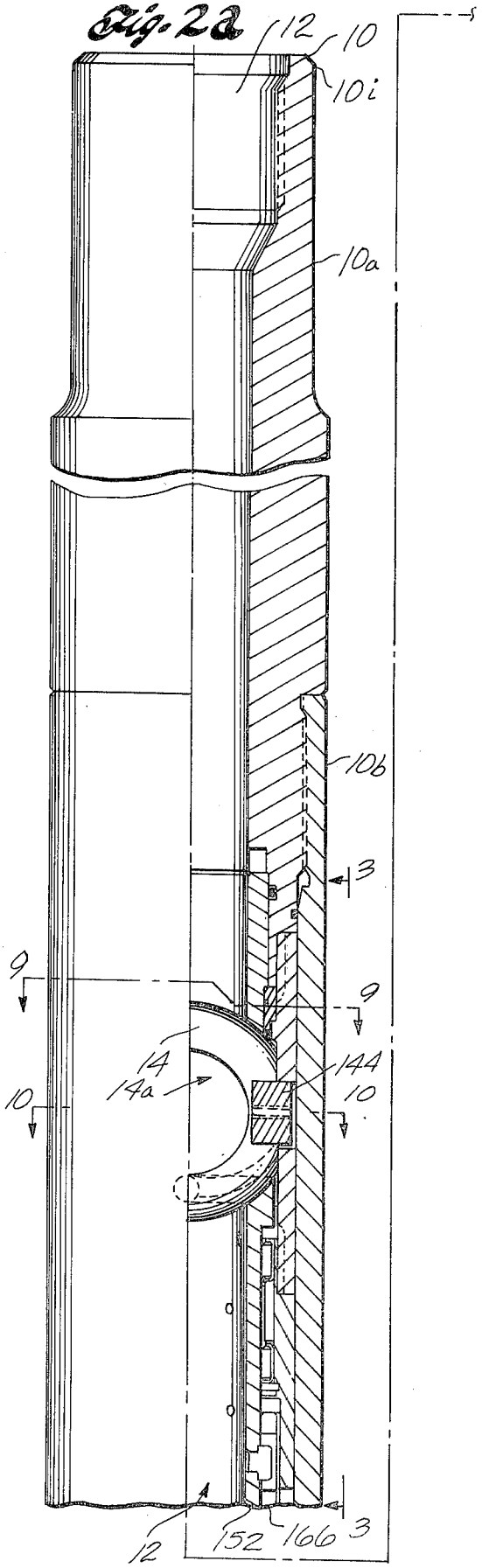
Figures 2B, 2C, 2D:
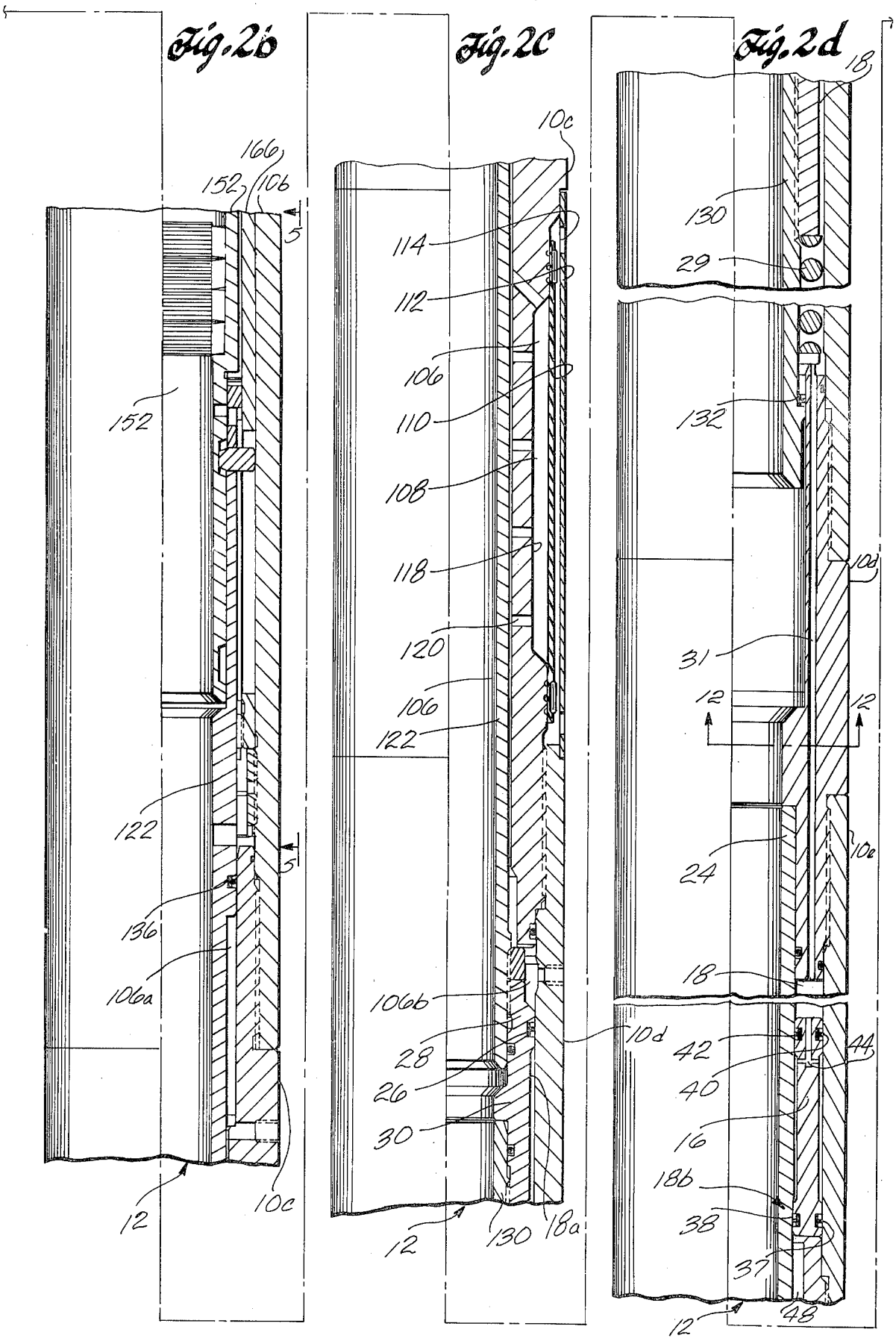

A central passage valve, hereinafter ball valve 14 (FIG. 2*a*) is mounted within the housing and is positioned in the central passage 12 so as to block the flow of fluid along the central passage 12 when positioned as indicated in FIG. 2*a*. The ball valve 14 is generally spherical in shape and has a centrally located cylindrically shaped opening 14*a* extending therethrough. A floating piston 16 (FIG. 2*d*) is positioned within a pressure chamber 18 which extends from an upper end 18*a* (FIG. 2*c*) to a lower end 18*b* (FIG. 2*d*). The floating piston 16 is shown shouldered in its most downward position where it will be positioned prior to the time the test valve starts moving down the well hole up until annulus pressure affects its position. The portion of the chamber 18 between the upper chamber end 18*a* (FIG. 2*c*) and the lower end of the piston 16 forms a closed reservoir for a compressible fluid, preferably nitrogen. The main nitrogen reservoir is formed by the annular space between the inside of the tubular shaped housing sub 10*e* and tubular shaped inner mandrel 24. The upper end 18*a* chamber of chamber 18 is bounded by the lower side of seal 26 in the differential pressure responsive head 28 of a tubular shaped power piston 30. The lower end 18*b* of chamber 18 is bounded by seals 37, 38 on piston 16. Included within the chamber 18 containing the nitrogen are a bias spring 29 and the head 28 of power piston 30, the power piston 30 being slidable along the outer wall of the chamber 18 formed by the housing sub 10*d*.

Figure 12:
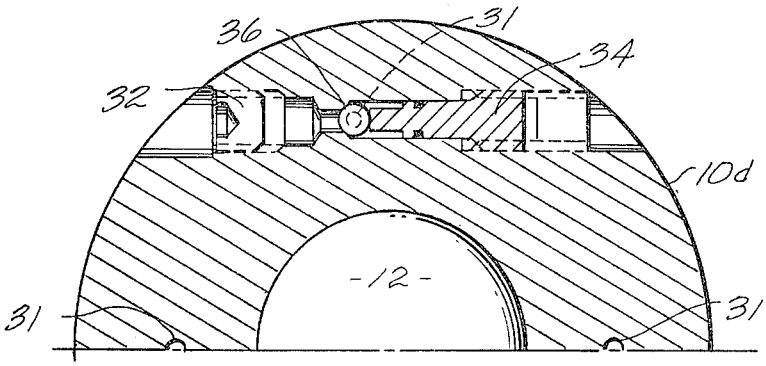
FIG. 12 is an enlarged cross-sectional view of the upper half of the test valve taken along lines 12—12 of FIG. *2d;*

Consider the valve arrangement for filling the nitrogen into the reservoir formed by chamber 18 as depicted in FIGS. 2*d* and 12. Included within the chamber 18 are a plurality of passages 31 extending through the housing sub 10*d*. A circular pipe plug 32 is removed and a screwdriver slotted circular plug 34 is backed away from a ball 36. Nitrogen gas is then supplied in through the opening from which the pipe plug 32 was removed, past the ball 36 into the passage 31. After the nitrogen has completely filled the reservoir formed by the chamber 18 including the passage 31, the screwdriver slotted plug 34 is tightened against the ball 36, closing off passage 31 (and chamber 18), and the pipe plug 32 is reinserted.

The passages 31 (see FIG. 8) are symmetrically positioned about and extend parallel to the central axis of the housing sub 10*d*, extending between the main chamber portion and the portion of the reservoir containing bias spring 29.

The portion of the chamber 18 between the housing sub 10*d* and the housing sub 10*f* is generally ring shaped and the floating piston 16 which is positioned therein is also generally ring shaped. The floating piston 16 has an outer ring shaped T type seal 37 and an inner ring shaped T type seal 38 at its lower end which provides the lower extremity for the nitrogen reservoir within chamber 18. Thus the nitrogen reservoir is effectively contained between seals 37, 38, and ring shaped T type seals 26 and 132 in the power piston 30. The floating piston 16 also contains ring shaped T seals 40 and 42 which are identical to T seals 37 and 38. However, holes 44 extend in a radial and longitudinal direction around the seals 40 and 42 and prevent these seals from being effective, their main purpose being to center the floating piston 16 within the chamber 18.

Figure 2E:
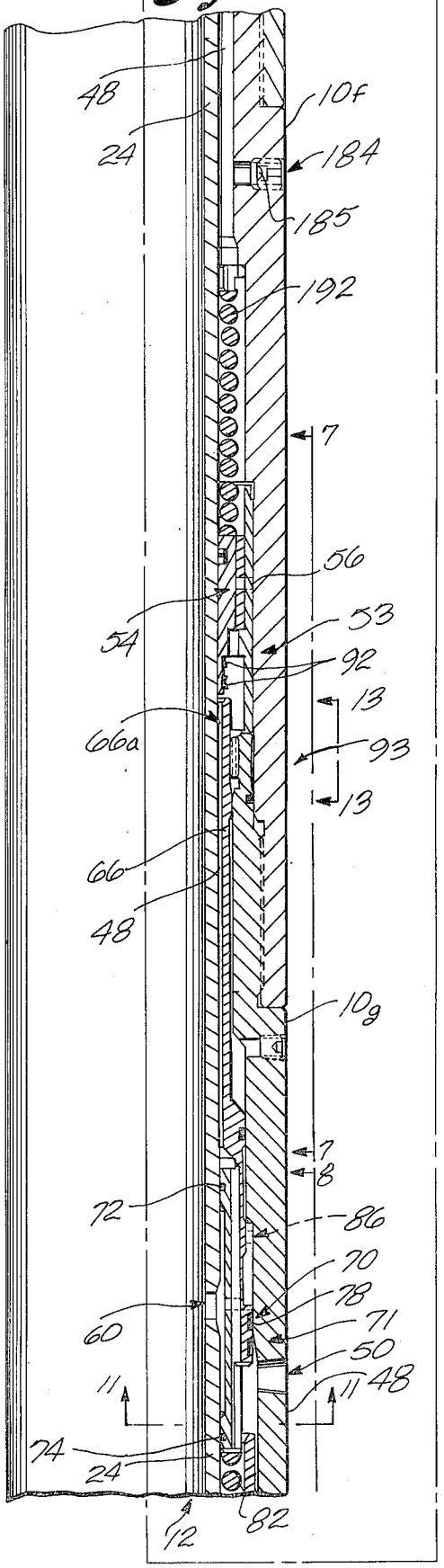
Figure 2F:
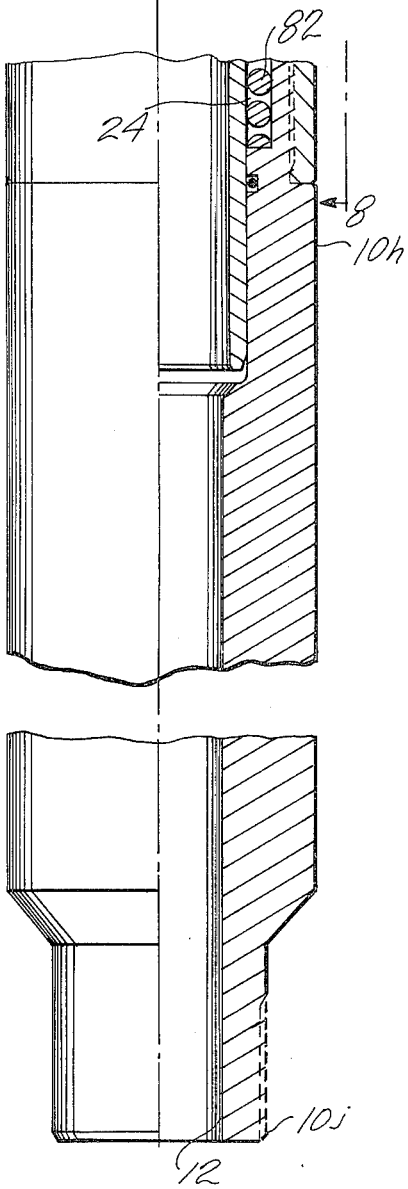

A further passage 48, isolated from chamber 18 by seals 37 and 38 of floating piston 16, forms an opening which extends between the seal 38 on floating piston 16 and a port 50 (FIG. 2*e*). To be explained, passage 48 and chamber 18 form a pressure chamber in which annulus pressure is trapped and used as a reference for control of the ball valve 14. Port 50 extends radially through housing sub 10*g*. As the test valve is being lowered into the well hole, annulus fluid enters the port 50 and moves up passage 48 to the lower end of the floating piston 16. The passage 48 is partially formed between the tubular shaped housing subs 10*f* and 10*g* and the inner floating piston mandrel 24 and as the test valve is being lowered into the well hole, the annulus fluid completely fills all of the space within the passage 48 up to the lower end of the floating piston 16.

Figure 7:
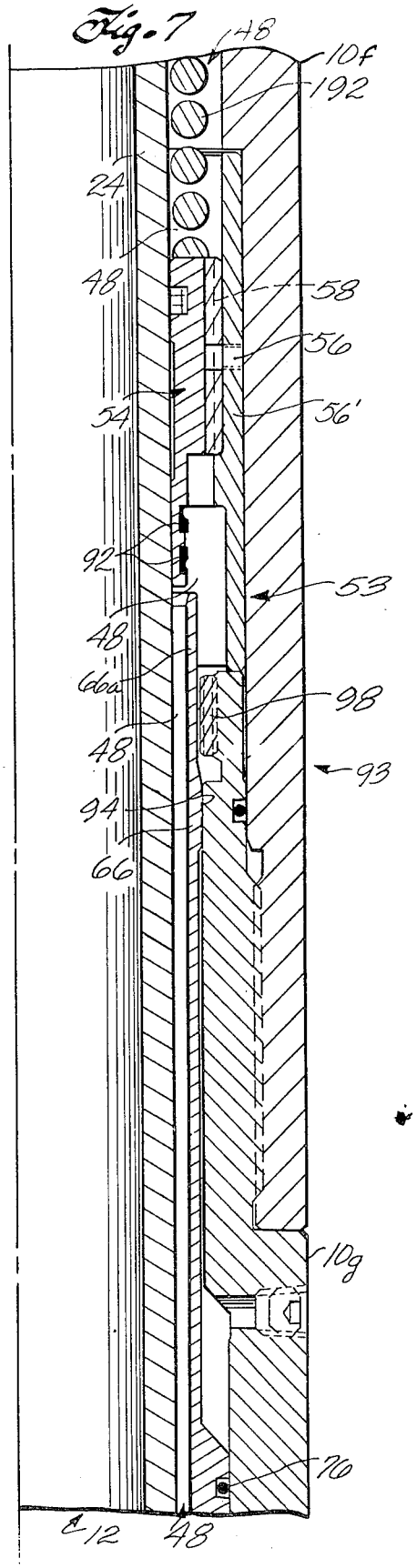
FIG. 7 is an enlarged view of the right hand quarter section of the test valve taken between the lines 7—7 of FIG. *2e;*

Referring to FIGS. 2*e* and 7, a sleeve shaped check valve member 54 is positioned within the ring shaped passage 48 and is held in an axial direction by a shear screw 56 which extends radially through a shear screw sleeve 56', surrounding member 54, into the member 54. The check valve member 54 has several chordal areas indicated generally at 58 extending around its outer diameter to provide sufficient fluid passage area for the annulus fluid to move past the check valve 54 up along the passage 48.

The nitrogen within the chamber 18 is prepressurized at the surface to a pressure dependent upon the estimated or known bottom hole temperature and pressure. For example, in a well 5,000 feet deep with a temperature of 150° F., the pressure of the nitrogen would be approximately 215 psi and in a 10,000 foot well with a temperature of 310° F., the pressure would be approximately 950 psi. Annulus pressure against the floating piston 16 in excess of the nitrogen pressure causes the floating piston 16 to move upwardly, thus compressing the nitrogen and raising its pressure so that it is equal to that of the annulus.

Figure 8:
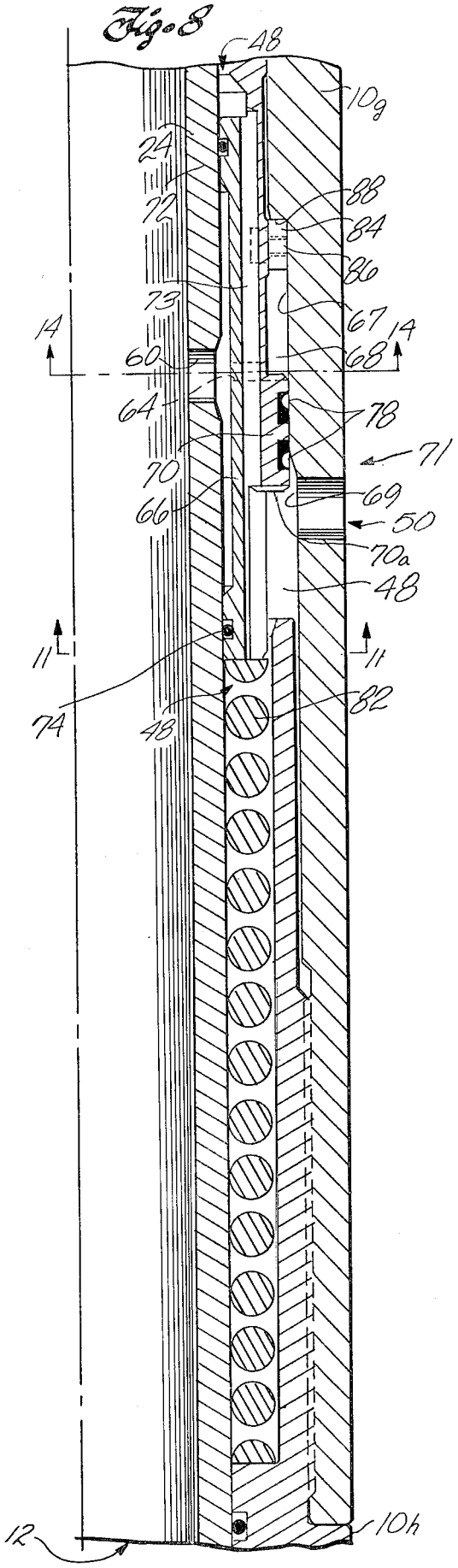
FIG. 8 is an enlarged view of the right hand quarter section of the test valve taken between the lines 8—8 of FIGS. *2e* and *2f;*
Figure 9:
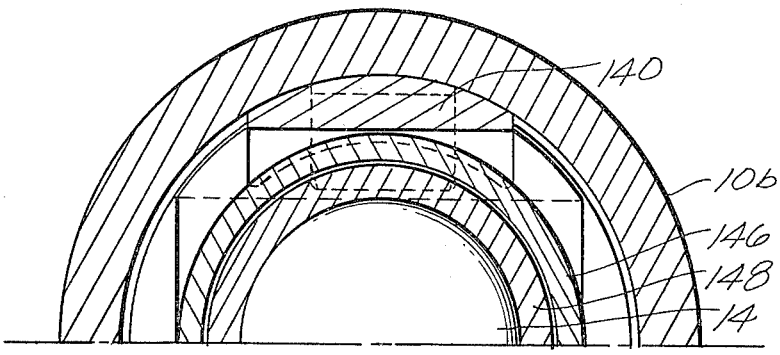
FIG. 9 is a cross-sectional view of the upper half of the test valve taken along lines 9—9 of FIG. *2a;*

During run-in of the test valve as the pressure of the annulus fluid starts moving the floating piston 16 upward, well fluid starts entering the central passage 12 clear up to the ball valve 14. Any trapped air within the central passage 12 if not absorbed by the fluid will occupy a small space between the fluid and the ball valve. Referring to FIGS. 2*e* and 8, the fluid passing through passage 12 also passes through a radially extending port 60, through the inner mandrel 24, to the inner diameter of a sleeve valve member 66 and through a radially extending hole 64 of the sleeve valve member 66 to the outer perimeter of the sleeve valve member 66 where a chamber 68 is located. The sleeve valve member 66 has a differential pressure responsive piston 70 against which pressure in the chamber 68 acts in a downward direction. The sleeve valve member 66 is elongated axially and slides within the generally ring shaped portion of the passage 48 in an axial direction. The inner diameter of the sleeve valve member 66 has O-ring type seals 72 and 74 positioned respectively at the upper and lower sides of the port 60 and seal against the inner floating piston mandrel 24 and the inner diameter of the sleeve valve member 66. Additionally, an O-ring type seal 76 and seals 78 on the outer diameter of sleeve valve member 66 seal against the inside wall 67 of housing sub 10*g* and define the upper and lower ends of the chamber portion 68. The seals 72, 74, 76 and 78 provide upper and lower seals for containing the fluid as it passes through port 60 and hole 64 into the chamber portion 68. The fluid from central passage 12 fills the space between the upper and lower seals 72 and 74 and between the upper and lower seals 76 and 78 and the pressure thereof acts against the annular area formed by the difference in diameter of the seals 76 and 78 (i.e., against the upper side of the piston 70), applying a force to the piston 70 in a downward direction.

During the time the test valve is being lowered in the well hole before the locator tube seal assembly is seated on the packer bore, the pressure of fluid in the central passage 12 is essentially equal to that of the annulus pressure around the test valve and, since the pressure areas on the upper and lower sides of the piston 70 are substantially equal, the net force balances out and the sleeve valve member 66 remains in the position depicted in FIG. 8.

Also, compression spring 82 is positioned between an inner shoulder on the housing sub 10*h* and the lower end of the sleeve valve member 66 and tends to hold the sleeve valve member 66 in the upward position indicated in FIG. 8. When the downward force on piston 70 due to the pressure of fluid entering chamber 68 from central passage 12 exceeds the force due to the pressure of the annulus fluid on the lower side of the piston 70, plus the force due to the compression spring 24, the piston 70 and hence the sleeve valve member 66 move downwardly. This occurs as the test string is lowered to its final position at the bottom of the well hole where the locator tube seal assembly starts to engage the packer bore, causing the mud displaced by the tubing seal assembly to be forced into the formation and into the central passage 12. With the sleeve valve member 66 moved downward, the seals 78 enter an enlarged diameter area 69 of the passage 48, allowing the fluid in the chamber portion 68 to bypass seals 78 out through the port 50 into the annulus around the test valve. As a result, the increased pressure is relieved from the central passage 12 into the annulus around the test valve, allowing the test string to be lowered to its final position without applying undue weight.

Figure 10:
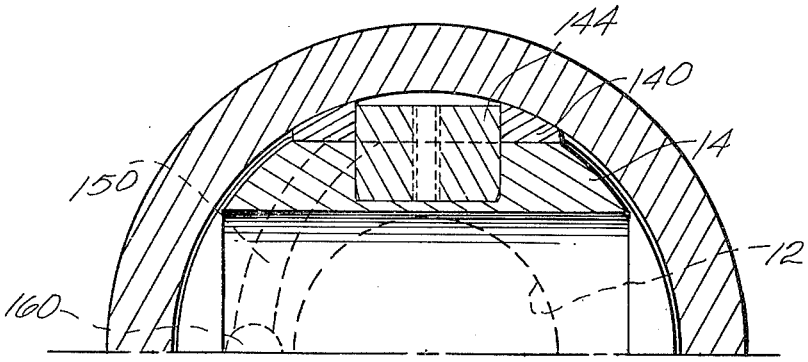
FIG. 10 is a cross-sectional view of the upper half of the test valve taken along lines 10—10 of FIG. *2a;*

The surface equipment is then hooked up to the test string and the well is ready for test. Pressure is applied at the surface to the annulus around the test string and hence around the test valve by pumping mud into the annulus. Prior to the increase in pressure, the compression spring 82 holds the sleeve valve member 66 so that seals 78 barely engage the wall 67 of the chamber portion 68. As annulus pressure increases, pressure on the lower surface of the piston 70 increases until the piston and hence the sleeve valve member 66 return to the position depicted in FIG. 10. As the piston 70 moves upward, fluid is forced from the chamber portion 68 back into the central passage 12 through hole 64 and port 60. However, shear ring 84 affixed to the sleeve valve member 66 by shear screw 86 shoulders out against shoulder 88 of housing sub 10*g* at the upper end of the chamber 68, preventing the sleeve valve member 66 from further upward movement.

Figure 11:
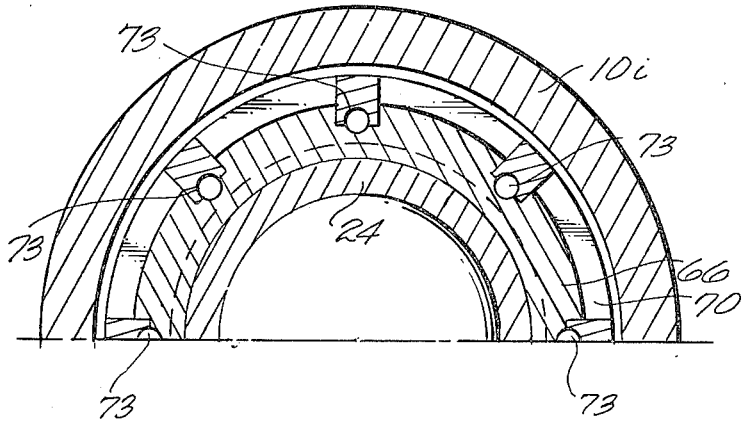
FIG. 11 is a cross-sectional view of the upper half of the test valve taken along the lines 11—11 of FIG. *2e;*

The increase in annulus fluid pressure causes fluid pressure to pass along passage 48, from the port 50 through axially extending holes 73 in sleeve valve member 66 (FIGS. 8 and 11), past the now open check valve 53, continuing along the passage 48 to the lower end of the floating piston 16 (FIG. 2*d*). As the pressure at the lower end of the floating piston 16 increases, the floating piston 16 moves upward, thereby causing the nitrogen pressure in chamber 18 to increase to the annulus pressure at the lower end of the piston 16.

As the annulus pressure increases, preferably to a pressure in the order of 800 psi, the pressure on the lower surface of the piston 70 increases to the point where the shear screw 86 shears, freeing the ring 84 from the sleeve valve 66, allowing the sleeve valve member 66 to move upward until its ring shaped end 66*a* moves into sealing engagement around the seals 92, thereby closing the portion of the passage 48 above check valve 53 from that below. When this occurs the pressure then existing in the passage 48 above the check valve 53 is trapped and is retained. Since the nitrogen pressure in chamber 18 is the same as the pressure in the chamber 48, the pressure in the nitrogen is also trapped and retained. To be explained in more detail, this trapped pressure forms a reference pressure which must be exceeded in order to open the ball valve 14 (FIG. 2*a*).

Figure 13:
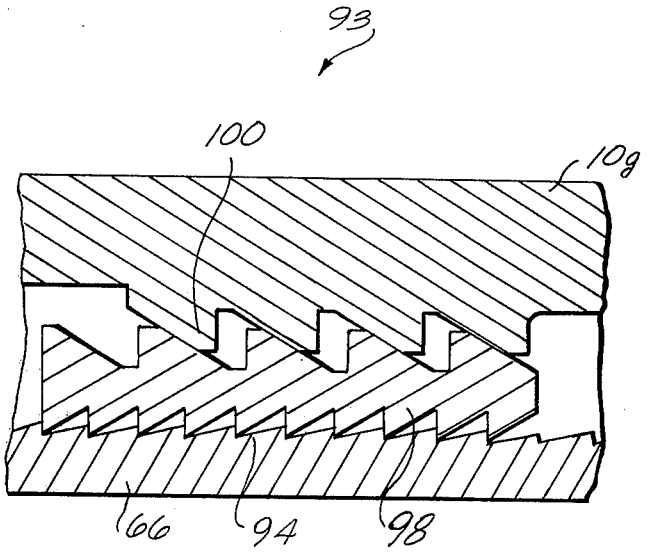
FIG. 13 is an enlarged section view of a portion of the upper ring shaped end of the sleeve valve member, the body lock ring and the housing sub taken along the lines 13—13 of FIG. *2e.
Figure 14:
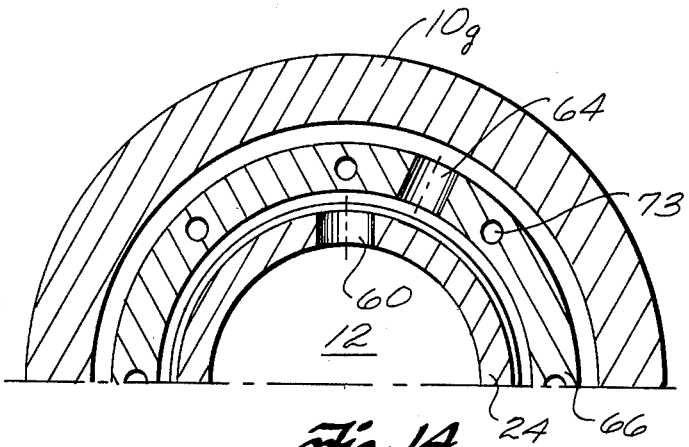
* and FIG. 14 is an enlarged cross-sectional view of the upper half of the test valve taken along the lines 14—14 of FIG. 8.

When check valve 53 closes due to the upward movement of the sleeve valve member 66, a lock 93 locks the sleeve valve member 66, preventing it from returning to its downward position and thus keeping the check valve 53 in a closed condition. The closed condition of check valve 53, to be explained in more detail, is subsequently released when check valve member 54 moves upwardly. The lock 93, depicted in FIGS. 7 and 13, includes buttress threads 94 on the outside diameter of sleeve valve member 66 which engage mating threads on the inside diameter of a body lock ring 98. The outer diameter of body lock ring 98 has threads which engage inwardly facing teeth 100 on the upper end of the housing sub 10*g*. Additionally, the body lock ring 98 is split (not shown) so that it can expand and the buttress threads on its outer diameter are coarser than the threads on the inner diameter. As a result the threads on the sleeve valve member 66 mate with the threads on the body lock ring so that when the sleeve valve member 66 is moved in an upward direction, the tapered flank of the teeth expand the ring into the outer coarser threads so as to permit the crest of the inner threads on the body lock ring and the outer threads on the sleeve valve member 66 to pass over each other with very little resistance, due to the expansion of the ring. However, movement of the sleeve valve member 66 in the downward direction is prevented because the tapered flanks of the outer threads mate and cam the body lock ring 98 inwardly so that the inner buttress threads are fully engaged.

With the check valve 53 locked closed, the passageway 48 is blocked and further changes in the annulus pressure, below over-pressure, will not affect the position of the floating piston 16. Hence the pressure trapped above the check valve 53 in passage 48 is retained.

Consider now the control mechanism for opening and closing the ball valve 14 responsive to annulus pressure exceeding the trapped nitrogen pressure.

Referring to FIGS. 2*a*, 2*b* and 2*c*, annulus shaped reservoir 106 extends around the test valve from an upper end 106*a* to a lower end 106*b* and contains a fluid, preferably oil 108, which has very slight compression over the pressure range of interest. Annulus pressure is applied to the reservoir of oil 108 through a ring shaped rubber diaphragm 110 which encircles the test valve. The diaphragm 110 is preferably a resilient rubber material and a tubular shaped protective sleeve 112 extends around the test valve over and slightly displaced from the rubber diaphragm 110. Ports 114 extend through the protective sleeve 112, allowing the annulus fluid to reach the rubber diaphragm 110. The housing sub 10*c* has a neckdowned portion 118, forming a part of the reservoir 106. Additionally, space is provided between the outer diameter of upper piston mandrel 122 and the inner diameter of the housing sub 10*c* which forms a part of the reservoir 106. The diaphragm 110 isolates the annulus fluid, usually mud, from the upper interior working parts of the test valve and transmits the annulus fluid pressure to the oil 108 which completely fills the reservoir 106.

Referring to FIGS. 2*c* and 2*d*, upper piston mandrel 122 and power piston 30 are generally sleeve shaped and move in an axial direction together within the test valve. At the lower end of the upper piston mandrel 122 and at the upper end of the power piston 30 is located the piston head 28. The piston head 28 is ring shaped and is formed as part of and on the outer diameter of power piston 30. The upper surface of the piston head 28 defines the lower end 106*b* of the oil reservoir 106. The power piston 30 is in turn rigidly connected through its inner diameter to the outer diameter of lower piston mandrel 130 and therefore move in an axial direction together. The lower piston mandrel 130 has its outer diameter sealed against the inner diameter of housing sub 10*d* by a ring shaped T seal 132. The upper end of the upper piston mandrel 122 (FIG. 2*b*) is sealed around its outer diameter to the inner wall of the housing sub 10*c* by T seal 136. The outer diameters of the seals 136 and 132 are the same and are the only ones on the valve assembly exposed to central passage pressure. Hence the central passage pressure is balanced across the piston assembly, including the upper piston mandrel 122, the power piston 30 and the lower piston mandrel 130 and has no tendency to move it. The bias of compression spring 29 acts to force the piston assembly, including the upper piston mandrel 122, the power piston 30 and the lower piston mandrel 130, in an upward direction.

Also during lowering of the test valve in the hole before check valve 53 closes, annulus pressure acts through passage 48 causing the same nitrogen pressure in chamber 18, and annulus pressure is applied through the oil in reservoir 106 and both act over the same area on piston head 28 of power piston 30. As a result the piston assembly has no tendency to move downward, due to annulus pressure, as the test valve moves down hole and before the check valve 53 closes.

After the test valve has landed and the locator tube assembly is sealed into the packer bore, annulus pressure is intentionally increased to actuate the test valve. This causes the oil pressure and nitrogen pressure to increase simultaneously until the check valve 53 is closed and traps the annulus pressure in the upper portion of passage 48 below the floating piston 16 as discussed above. Thereafter as annulus pressure increases, causing oil pressure to increase, the nitrogen pressure can no longer increase due to action below the floating piston 16 because the check valve 53 is closed. As annulus pressure and hence oil pressure increase, a point is reached where the oil pressure acting against differential head 28 on power piston 30 overcomes the precompression of the bias spring 29. The piston assembly including the upper piston mandrel 122, the power piston 30 and the lower piston mandrel 130, now start moving downward because of the greater force on the upper face of piston head 28, thereby compressing the nitrogen below the piston head 28. The volume of the nitrogen reservoir, the nitrogen precharge pressure, and the displacement of the piston assembly when moved through its full stroke, have been arbitrarily selected so that the nitrogen pressure, at full stroke, has increased by the same amount of pressure which was initially trapped in the nitrogen when the check valve 53 closed the passage 48. To achieve full movement of the piston assembly, the annulus pressure is preferably 250 psi greater than the nitrogen pressure due to the force required to compress the spring. However, this relationship is not critical and was selected because it provides about the same force acting to move the piston assembly to the top of the stroke when annulus pressure is bled off as was available to initially start the piston moving downward.

It is to be noted that the above described downward movement of the piston assembly including the upper piston mandrel 122, the power piston 30 and the lower piston mandrel 130, is the motion that causes the ball valve 14 to move from its closed to its open position.

Referring to FIGS. 2*a* and 3–6, the ball valve 14 has hole 14*a* therethrough which, when in the open position extending axially along the central passage 12, provides room for instruments or perforating guns and provides adequate flow area for testing high volume formation fluid. The ball valve 14 is flattened, as indicated at 14*b*, at opposite sides of the ball at right angles to the axis of the opening 14*a*. Each of the flattened portions 14*b* is fitted with a separate mounting bar 140 (only one shown) which is fitted within the inner diameter of the housing sub 10*b*. A pair of journals 144 are symmetrically provided on opposite sides of the ball valve 14, one for each of the flattened areas 14*b*. Each journal 144 extends between a hole provided in the corresponding mounting bar 140 and into an opening in the ball valve 14 through the corresponding flattened area 14*b*. A resilient ring shaped seal 145 is bonded to a seal ring 146 which is mounted on the external diameter of a replaceable cylindrical shaped ball seat 148 to thereby provide a bubble-type seal against the ball valve 14. The seal ring 146 is retained by a shoulder machined on the inside of each mounting bar 140.

Referring to FIGS. 3, 4 and 6 a semicircular shaped groove or track 150 is machined on the periphery of the ball valve 14 in a plane cutting through the axis of the journals 144 and at 45° to the opening 14*a* through the ball valve 14. The groove 150 extends on one end to at least the plane of a diameter cut through the center of the ball valve 14 at right angles to the journals 144, and on the other end to a point such that a line through this point to the center of the ball valve 14 would make an angle less than 45° with the axis of the journals.

A drive sleeve 152 is concentric with and forms the outer wall of the central passage 12 and has an upper surface 152*a* which mates with the lower side of the outer surface of the ball valve 14. The drive sleeve 152 has a semispherical indentation 158 in its upper surface 152*a* which receives a hardened cam ball 160 and which in turn is aligned with the semicircular shaped groove 150 in the periphery of the ball valve 14. Preferably the cam ball 160 is made of a hard material such as tungsten carbide or hardened steel.

In the position depicted in FIG. 3, the distance from the center of the cam ball 160 to a plane passing through the journals 144 and a center line of the test valve is a maximum and is equal to the vertical distance from the center line of the journals to the cam ball 160. When the drive sleeve 152 is rotated 90°, the vertical distance remains constant but the distance to the center line decreases to zero. Thus the only time that the point on the groove can also have a zero distance from the center line is when the plane of the groove coincides with the plane through the journals and the center line of the test valve. That is, when the drive sleeve is rotated 90°, the ball valve 14 rotates 45° and is half open. To fully open the ball valve 14 or turn it 90°, the drive sleeve 152 must be rotated 180°.

Referring to FIGS. 3 and 4, the drive sleeve 152 is rotatably mounted on the inside of a ring of needle bearings 162. The rings of needle bearings 162 are contained in races and extend around the perimeter of the drive sleeve 152 with their axes aligned with the axis of the test valve. The rings of needle bearings 162 are mounted on opposite ends of a ring shaped spacer 164 which in turn is mounted inside a bushing sleeve 165. The bushing sleeve 165 is affixed against rotation at its upper end by slots 169 (FIG. 4) which mate with the lower end of the mounting bars 140.

As depicted in FIG. 4, the upper end of the mounting bars 140 also extend into slots 171 milled in the bottom end of the housing sub 10*a*. As a result the bushing sleeve 165 cannot turn with respect to the mounting bars 140 nor the top housing sub 10*a*.

The lower end of the bushing sleeve 165 is held in place by a castellated nut and lock nut 170 (FIG. 5) screwed into a thread in the inner diameter of the housing sub 10*b*. The lower end of the drive sleeve 152 extends inside cam sleeve 166 (FIG. 5) and is rotationally locked to it by four cap screws 168, only one being shown (FIG. 3), which are displaced around the circumference of the drive sleeve 152.

A stack of ring shaped Belleville type washers 172 (FIG. 5) is trapped between the end of the drive sleeve 152 and an internal shoulder 166*a*, on the cam sleeve 166. The Belleville washers 172 hold the ball valve 14 upward in sealed engagement with the ball seat 148 and the seal ring 146. Pressure in the central passage 12 from below adds to the force provided by the Belleville washers 172.

However, if pressure above the ball valve 14 exceeds that below by a nominal amount, it will cause the ball valve 14 to move away from ball seat 148 slightly so that fluid passes around the closed ball valve 14 and reenters the central passage 12 of the test valve through holes 180 (FIG. 3) drilled through the drive sleeve 152.

The downward force of the Belleville washers 172 on the cam sleeve 166 is carried by a thrust bearing 184 which in turn is supported by bushing sleeve 165 through a washer 186 and spacer sleeve 187 and retaining nut 188.

The bushing sleeve 165 and spacer sleeve 187 have two sets of mating longitudinal slots 189 and 191, respectively, positioned at 180° and a separate pin 190 rides in each (only one being shown). The cam pins extend through close fitting holes in the top end of the upper piston mandrel 122 and into helical camways 194 located in the bottom end of the cam sleeve 166 (see FIGS. 5 and 6). With this arrangement, downward movement of the piston assembly pulls the cam pins 190 through the corresponding camways 194 and rotates the cam sleeve 166 and drive sleeve 152 by 180° with respect to the ball valve 14 which, as explained above, rotates the ball valve 14 by 90° to an open condition.

Consider now the way in which the ball valve 14 of the test valve is maintained closed after completion of the formation test and over-pressure is applied in the annulus. The test valve is maintained closed by increasing annulus pressure above the normal open pressure to an over-pressure condition. Valve member 54 acts as a differential piston with trapped pressure on the upper side and annulus pressure on the lower end. The over-pressure exerts sufficient pressure on the lower end of the check valve member 54, through port 50 and the lower portion of passage 48, to shear off the screw 56 holding the check valve member 54 in the position indicated in FIGS. 2*a* and 7. As a result, check valve member 54 moves upwardly away from the upper end 66*a* of the sleeve valve member 66, thereby reopening the passage 48, up to the floating piston 16, to annulus pressure through the port 50. As a result the lower end of the floating piston 16 is again subjected to annulus pressure, causing the floating piston 16 to move upward, compressing the nitrogen until its pressure equals annulus pressure. Since the pressure across the piston assembly is again equalized, the bias spring 29 (FIG. 2*d*) again moves the piston assembly upward, automatically closing the ball valve 14. When annulus pressure is bled back down, the pressure exerted on the lower end of the check valve member 54 allows the compression spring 192 to move the check valve member 54 downward into sealing engagement with the upper end 66*a* of the sleeve valve member 66, again closing the passage 48 to annulus pressure, thereby again trapping fluid pressure in the chamber 18. As a result, the nitrogen pressure in chamber 18 is maintained at the highest over-pressure to which it has been subjected and now exerts this over-pressure on the piston assembly including the piston head 28, holding it in its upward position with the ball valve 14 closed. In this manner the test valve is no longer sensitive to normal fluctuations in annulus pressure.

With this arrangement the ball valve 14 is assured of automatically closing if annulus pressure inadvertently increases, as may happen if tubing parts or well fluid are leaked into the annulus during a test.

It is a dangerous condition to bring the test valve to the surface with the high pressure trapped above the check valve 53. Accordingly, a rupture disc 185 is mounted in a pipe plug 184 which in turn is in a passage which extends radially through the housing sub 10*f* to the passage 48. Since the rupture disc 185 is exposed on one side to trapped fluid pressure in passage 48 and exposed on the other side to annulus pressure, the pressure across the rupture disc 185 increases as the test valve is raised and hydrostatic annulus pressure drops. The rupture disc 185 is set to rupture at some predetermined differential pressure thereacross thereby allowing the trapped annulus pressure above check valve 53 to bleed out into the annulus, reducing the nitrogen pressure to its original prepressure condition.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed:

1. Well test apparatus having, in a well, an annulus therearound comprising:

tubular housing means having valve means therein for the control of fluid flow therethrough;

a pressure chamber within said housing;

trapping means responsive to annulus pressure for trapping pressure in said pressure chamber;

locking means for maintaining said pressure trapping means in the trapping condition with variations in annulus pressure; and control means responsive to trapped pressure in said pressure chamber and to annulus pressure for control of said valve means.

2. Well test apparatus according to claim 1 comprising:

pressure equalizing piston means in the pressure chamber; and a compressible fluid in said chamber on one side of said piston means, the control means being responsive to the pressure in said fluid to urge said valve means to a closed condition preventing fluid flow.

3. Well test apparatus according to claim 2 comprising:

a chamber portion on the opposite side of said piston means from said fluid, said trapping means comprising means for trapping pressure from the annulus in said chamber portion.

4. Well test apparatus according to claim 1 comprising means for preventing said trapping means from trapping pressure until annulus pressure exceeds a predetermined level.

5. Well test apparatus according to claim 4 comprising breakaway means for restraining said trapping means from trapping pressure for annulus pressure below the predetermined level.

6. Well test apparatus according to claim 1 wherein said trapping means comprises means for trapping annulus pressure which is a predetermined amount above initial hydrostatic annulus pressure.

7. Well test apparatus according to claim 1 wherein said trapping means comprises:

a passage;

a piston movably mounted in said passage and exposed to annulus pressure, movement of said piston responsive to annulus pressure causing said trapping means to trap pressure in said pressure chamber.

8. Well test apparatus according to claim 1 comprising means responsive to annulus pressure, exceeding by a predetermined amount the trapped pressure, for rendering the control means ineffective for opening the valve means.

9. Well test apparatus according to claim 1 comprising:

a passage between the annulus and the pressure chamber;

further valve means for the pressure chamber; and piston means movably mounted in the passage and exposed to annulus pressure and trapped pressure and responsive to a predetermined pressure in the annulus in excess of trapped pressure for causing the further valve means to reopen the pressure chamber to annulus pressure.

10. Well test apparatus according to claim 9 comprising breakaway means for maintaining said further valve means in a closed condition.

11. Well test apparatus according to claim 9 comprising spring means for causing said further valve means to close the pressure chamber to annulus pressure after it has been reopened when the excess pressure of the annulus is reduced.

12. Well test apparatus according to claim 1 comprising means for releasing the trapped pressure responsive to a predetermined difference between trapped pressure and annulus pressure.

13. Well test apparatus having, in a well, an annulus therearound comprising:

tubular housing means;

valve means for the control of the passage of fluid through the housing means;

a pressure chamber within said housing;

locking pressure trapping means responsive to annulus pressure for locking in a condition wherein pressure is trapped in said pressure chamber; and control means responsive to trapped pressure and annulus pressure for control of said valve means.

14. Well test apparatus having, in a well, an annulus therearound comprising:

housing means having a central passage therethrough;

valve means for the central passage;

a pressure chamber within said housing having an opening exposed to the annulus;

a valve having an open condition and locked closed condition for said opening;

means responsive to annulus pressure for closing and locking said valve to thereby trap pressure in said pressure chamber; and control means responsive to trapped pressure and annulus pressure for control of said valve means.

15. Well test apparatus having, in a well, an annulus therearound comprising:

tubular housing means having a central passage therethrough;

valve means for the central passage;

a pressure chamber within said housing having an opening exposed to annulus pressure;

a valve for closing said opening to thereby trap annulus pressure in the pressure chamber;

differential pressure responsive means responding to annulus pressure in excess of central passage pressure for closing said valve;

a lock operable for locking the valve in a closed condition when the valve is closed even though annulus pressure is decreased; and control means responsive to trapped pressure in said pressure chamber and to annulus pressure for control of said valve means.

16. Well test apparatus according to claim 15 wherein said differential pressure responsive means comprises:

a passage; and differential piston means slidably mounted in said passage, the piston means being exposed on opposite sides thereof to annulus pressure and central passage pressure, movement of the piston means due to annulus pressure causing said valve to trap pressure.

17. Well test apparatus according to claim 16 comprising means restraining movement of said piston means for pressure differentials under a predetermined level.

18. Well test apparatus according to claim 17 wherein said restraining means comprises breakaway means.

19. Well test apparatus having, in a well, an annulus therearound comprising:

a tubular housing having a central passage therethrough;

a central passage valve;

a pressure chamber within said housing;

a further valve having an open condition exposing the pressure chamber to annulus pressure and a closed condition for trapping annulus pressure in the pressure chamber;

a piston for urging the further valve to the closed condition responsive to annulus pressure;

a lock for maintaining the further valve closed; and a further piston differentially responsive to trapped pressure in said pressure chamber and to annulus pressure for control of said central passage valve.

20. Well test apparatus according to claim 19 wherein said lock comprises a first locking part connected to said housing and a second locking part connected to said further valve.

21. Well test apparatus having, in a well, an annulus therearound comprising:

a housing having a central passage therethrough;

valve means in the central passage having open and closed conditions;

a pressure chamber within the housing;

control means responsive to trapped pressure in said pressure chamber for urging said valve means to a closed condition and responsive to annulus pressure exceeding trapped pressure for urging said valve means open;

a passage between the annulus and said pressure chamber;

a further passage through the housing between the annulus and the central passage;

further valve means for opening and closing said further passage;

differential pressure responsive means responsive to central passage pressure and annulus pressure for control of said further valve means;

still further valve means having in said passage an open condition and a closed condition for the passage of pressure between said annulus and the pressure chamber;

further differential pressure responsive means responsive to annulus pressure exceeding central passage pressure for causing said still further valve means to close thereby trapping pressure from the annulus in the pressure chamber;

lock means for locking said still further valve means in a closed condition when closed by the further differential pressure responsive means;

still further differential pressure responsive means for overriding said lock means and for enabling said still further valve means to reopen the pressure chamber to annulus pressure responsive to annulus pressure exceeding pressure trapped in said pressure chamber by a predetermined amount to thereby render said control means unresponsive to annulus pressure; and means for urging said still further valve means closed after it has been reopened to thereby retrap the annulus pressure in the pressure chamber when annulus pressure and pressure in said pressure chamber are in a predetermined relation.

22. Well test apparatus according to claim 21 comprising means for preventing said further valve means from closing the further passage until annulus pressure exceeds central passage pressure by a predetermined amount.

23. Well test apparatus according to claim 22 comprising means for biasing said further valve means in the direction of the closed condition thereof.

24. Well test apparatus according to claim 21 comprising means for preventing said still further valve means from closing for the first time until annulus pressure exceeds central passage pressure by a predetermined amount.

25. Well test apparatus according to claim 21 wherein said control means comprises means for urging said valve means toward the closed condition thereof.

* * * * *

UNITED STATES PATENT OFFICE

CERTIFICATE OF CORRECTION

Patent No. 4,125,165 Dated November 14, 1978

Inventor(s) Sydney S. Helmus

It is certified that error appears in the above-identified patent and that said Letters Patent are hereby corrected as shown below:

The term of this patent subsequent to August 8, 1995 has been disclaimed.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*